US012121766B2

(12) United States Patent
Schneer

(10) Patent No.: US 12,121,766 B2
(45) Date of Patent: Oct. 22, 2024

(54) UPPER POSTERIOR DEVELOPMENT DEVICE

(71) Applicant: Brandon M. Schneer, Chalfont, PA (US)

(72) Inventor: Brandon M. Schneer, Chalfont, PA (US)

( * ) Notice: Subject to any disclaimer, the term of this patent is extended or adjusted under 35 U.S.C. 154(b) by 0 days.

(21) Appl. No.: 18/228,811

(22) Filed: Aug. 1, 2023

(65) Prior Publication Data

US 2023/0372769 A1 Nov. 23, 2023

Related U.S. Application Data

(63) Continuation of application No. 17/560,135, filed on Dec. 22, 2021, now Pat. No. 11,779,797.

(51) Int. Cl.

| | |
|---|---|
| ***A63B 21/00*** | (2006.01) |
| ***A63B 21/06*** | (2006.01) |
| ***A63B 23/02*** | (2006.01) |

(52) U.S. Cl.

CPC ..... *A63B 21/4029* (2015.10); *A63B 21/0615* (2013.01); *A63B 21/4033* (2015.10); *A63B 21/4047* (2015.10); *A63B 23/0211* (2013.01); *A63B 23/0233* (2013.01)

(58) Field of Classification Search

CPC ..... A63B 21/0615; A63B 21/4029; A63B 21/00047; A63B 21/00058; A63B 21/00061; A63B 21/0065; A63B 21/06; A63B 21/0608; A63B 21/0617; A63B 21/072; A63B 21/078; A63B 21/08; A63B 21/4019; A63B 21/4023; A63B 21/4033; A63B 21/4034; A63B 21/4047; A63B 23/0211; A63B 23/0233

See application file for complete search history.

(56) References Cited

U.S. PATENT DOCUMENTS

| | | | | |
|---|---|---|---|---|
| 4,546,968 | A * | 10/1985 | Silberman | A63B 21/4047 482/97 |
| 4,923,195 | A * | 5/1990 | Calderone | A63B 23/1281 482/97 |
| 5,356,359 | A * | 10/1994 | Simmons | A63B 21/4035 482/142 |
| 7,473,212 | B2 * | 1/2009 | Simmons | A63B 21/4047 482/145 |
| 8,529,413 | B2 * | 9/2013 | Simmons | A63B 21/4013 482/137 |
| 9,144,702 | B2 * | 9/2015 | Calderone | A63B 21/0616 |
| 11,229,821 | B2 * | 1/2022 | McDougle | A63B 23/0233 |
| 2008/0312051 | A1 * | 12/2008 | Manyseng | A63B 21/169 482/92 |
| 2019/0015695 | A1 * | 1/2019 | Simmons | A63B 21/4047 |

* cited by examiner

*Primary Examiner* — Megan Anderson
(74) *Attorney, Agent, or Firm* — IP Works PLLC

(57) ABSTRACT

An upper posterior development device is shown and described. The upper posterior development device includes a frame. The frame is created by a plurality of legs. The legs may be secured to one another at a bottom end for additional support. A bench is secured to the upper end of at least one of the plurality of legs. The bench may be rotatably secured to the frame such that the angle of the bench is adjustable. In this instance the bench is secured at least one different leg of the plurality of legs via an adjustment device. A pendulum movably secured to an underside of the bench. The pendulum is configured to have weight added or removed therefrom.

10 Claims, 5 Drawing Sheets

UPPER POSTERIOR DEVELOPMENT DEVICE

CROSS REFERENCE TO RELATED APPLICATIONS

This application claims the benefit of U.S. Non-Provisional application Ser. No. 17/560,135 filed on Dec. 22, 2021. The above identified patent application is herein incorporated by reference in its entirety to provide continuity of disclosure.

BACKGROUND OF THE INVENTION

The present invention relates to exercise equipment. More particularly, the present invention provides a device having a bench and a pendulum which is specially created to allow an individual to strengthen the posterior of the body.

Many people are using free weights to workout. One of the major groups of muscles that are commonly worked on is the posterior, or back muscles. There is traditionally only a limited number of exercises which can be performed to workout the back muscles. This limited number is shrunken even more if one prefers to use strictly free weights to workout.

Currently, there are only a few benches for lifting with free weights. None of these benches can be used to work out the back muscles by moving ones arms from a downward direction to above the head while laying prone. Further, none of the existing benches can be uses as a one bench fits all bench. While there are specialty benches for various back exercises, multiple of these need to be purchased to complete different workouts and thus a workout session. Currently, benches for working out sell for hundreds of dollars. As such, buying multiple benches comes at a large cost for both and individual and a gym.

Consequently, there is a need for an improvement in the art of exercise devices. The present invention substantially diverges in design elements from the known art while at the same time solves a problem many people face when attempting to strengthen the back with limited equipment. In this regard the present invention substantially fulfills these needs.

SUMMARY OF THE INVENTION

The present invention provides an upper posterior development device wherein the same can be utilized for providing convenience for the user when performing exercises meant to strengthen the back. The present system comprises a frame, wherein the frame is comprised of a plurality of legs. A bench secured to a top end of each of the plurality of legs. A pendulum movably secured to an underside of the bench.

Another object of the upper posterior development device is to have the bench include an aperture located at one end of the bench.

Another object of the upper posterior development device is to have a cross bar to secure two legs together, the bench is then secured to the cross bar.

Another object of the upper posterior development device is to have at least one of the plurality of legs include a plurality of apertures located therein, a hook is removably secured to at least one of the apertures.

Another object of the upper posterior development device is to have a cross bar to secure two legs together, the bench is then secured to the cross bar.

Another object of the upper posterior development device is to have a track secured to an underside of the bench, wherein the pendulum is movably secured to the track.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

LIST OF REFERENCE NUMERALS

Figure 1:
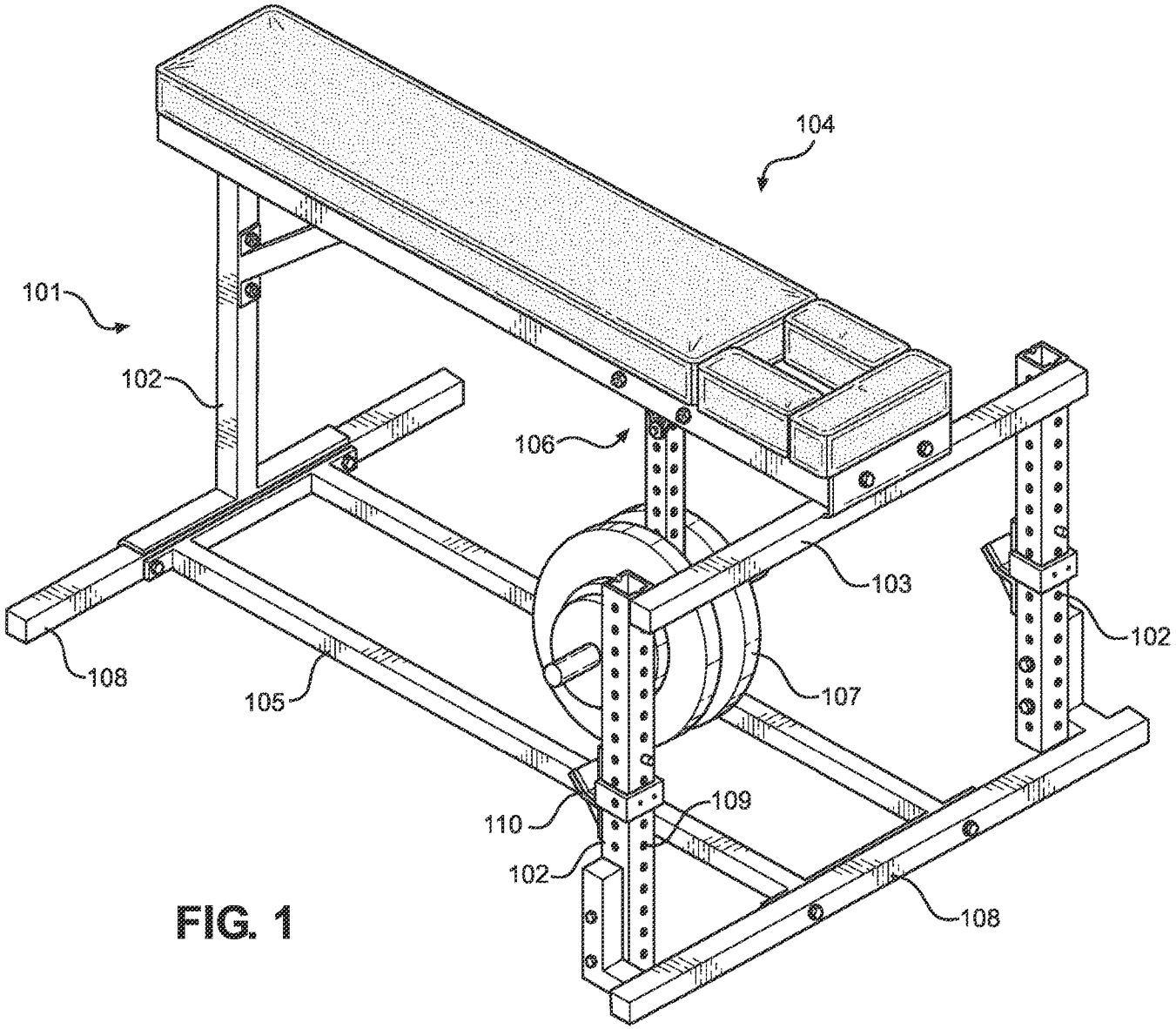
FIG. 1 shows a perspective view of an embodiment of the upper posterior development device.

With regard to the reference numerals used, the following numbering is used throughout the drawings.

101 Frame
102 Legs
103 Cross Bar
104 Bench
105 Supports
106 Pendulum
107 Weights
108 Stabilizers
109 Apertures
110 Hook
201 Bends
301 Frame
**301*a*** Frame Cutout
302 Aperture
303 Movable Plate
304 Wings
305 Apertures
403 Back Board
404 Telescopic Adjustment Point
**404*a*** Push Pin
**405*a*** Telescopic Insert
**405*b*** Apertures
**405*c*** Pull Pin
501 Hinge
**502*a*** Telescopic Adjustment
**502*b*** Push Pin
**502*c*** Equally Spaced Apertures
503 Hinge

DETAILED DESCRIPTION OF THE INVENTION

Reference is made herein to the attached drawings. Like reference numerals are used throughout the drawings to depict like or similar elements of the upper posterior development device. For the purposes of presenting a brief and clear description of the present invention, a preferred embodiment will be discussed as used for the upper posterior development device. The figures are intended for representative purposes only and should not be considered to be limiting in any respect.

Referring now to FIG. 1, there is shown a perspective view of an embodiment of the upper posterior development device. The upper posterior development device is comprised of a frame 101. In one embodiment the frame is solely comprised of a plurality of legs 102. In this embodiment the plurality of legs 102 id secured to a bench 104. In this embodiment the legs will hold and support the bench 104 in an upright position.

In one embodiment at least two of the plurality of legs 102 include a series of apertures 109 running along the length of each of the legs 102. The apertures 109 are configured to match each other in placement. In one embodiment the apertures 109 will have at least one hook 110 secured therein. The matching placement of the apertures 109 will allow the for hooks 110 to align when more than one hook is used. In one embodiment the hook(s) 110 will allow for a workout bar to be supported thereon.

The underside of the bench 104 has a pendulum 106 secured thereto. In this embodiment the location of the pendulum 106 is fixed along the length of the bench. In other embodiments as described below the location of the pendulum 106 is movable. The pendulum 106 is secured to the bench 104 such that it can move on at least one plane. In another embodiment the pendulum 106 is secured to the bench 104 such that it may be swung on multiple planes. The pendulum 106 is configured to have weights 107 secured thereto. In one embodiment a pair of cylinders are secure to each side of the pendulum 106. These cylinders are configured to work with free weights 107. In one embodiment the cylinders are configured to have Standard free weights 107 secured thereto. In another embodiment the cylinders are configured to have Olympic free weights 107 secured thereto.

In another embodiment the frame includes a cross bar 103. In this embodiment at least two of the plurality of legs 102 are secured to the cross bar 103. The bench 104 is then secured to the cross bar 103 and at least one additional leg 102. The cross bar 103 allows for a plurality of the legs 102 to be wider spaced. This spacing gives the device a better balance when in use. Further benefits are described below.

In a further embodiment the plurality of legs 102 are secured to stabilizers 108 at a bottom end of the legs. The stabilizers 108 will help to ensure a wider base. The wider base will prevent the device from tipping when in use. In yet another embodiment additional supports 105 are included. In the shown embodiment there are additional supports 105 that connect the pair of stabilizers 108. In this embodiment the additional supports 105 will prevent the plurality of legs 102 from separating and the bench 104 from sinking.

Figure 2:
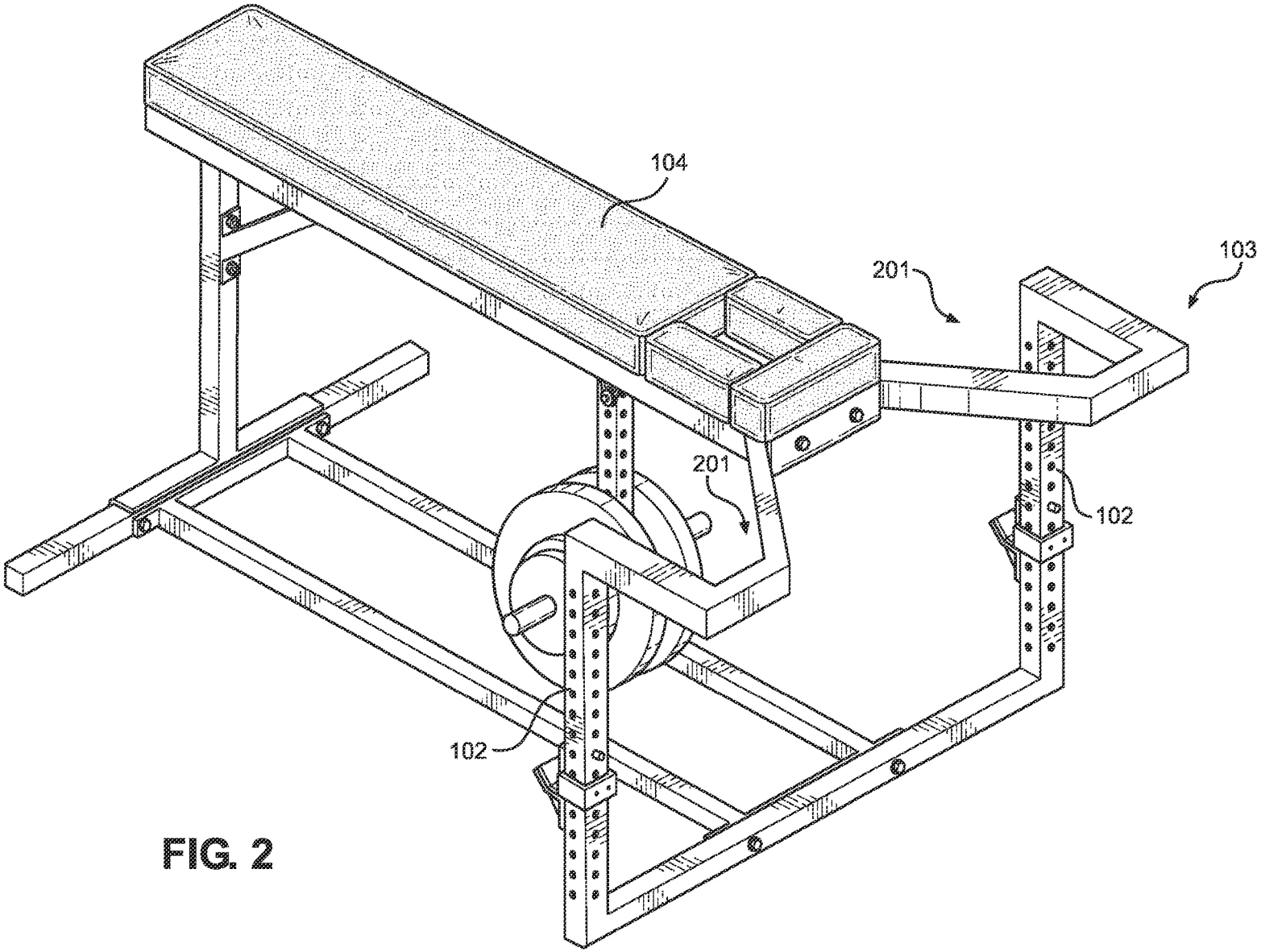
FIG. 2 shows a perspective view of an embodiment of the upper posterior development device.

Referring now to FIG. 2, there is shown a perspective view of an embodiment of the upper posterior development device. In the shown embodiment the cross bar 103 has a pair of bends 201 located along the length of the cross bar 103. In this embodiment the cross bar 103 is still secured to a top end of at least two of the plurality of legs 102. The bench 104 is secured to the cross bar 103. The pair of bends 201 will allow for a user to raise their arms through the bends 201 when in use. In the previous embodiments the arms would hit the cross bar 103. This could limit the range of motion during use.

Figure 3:
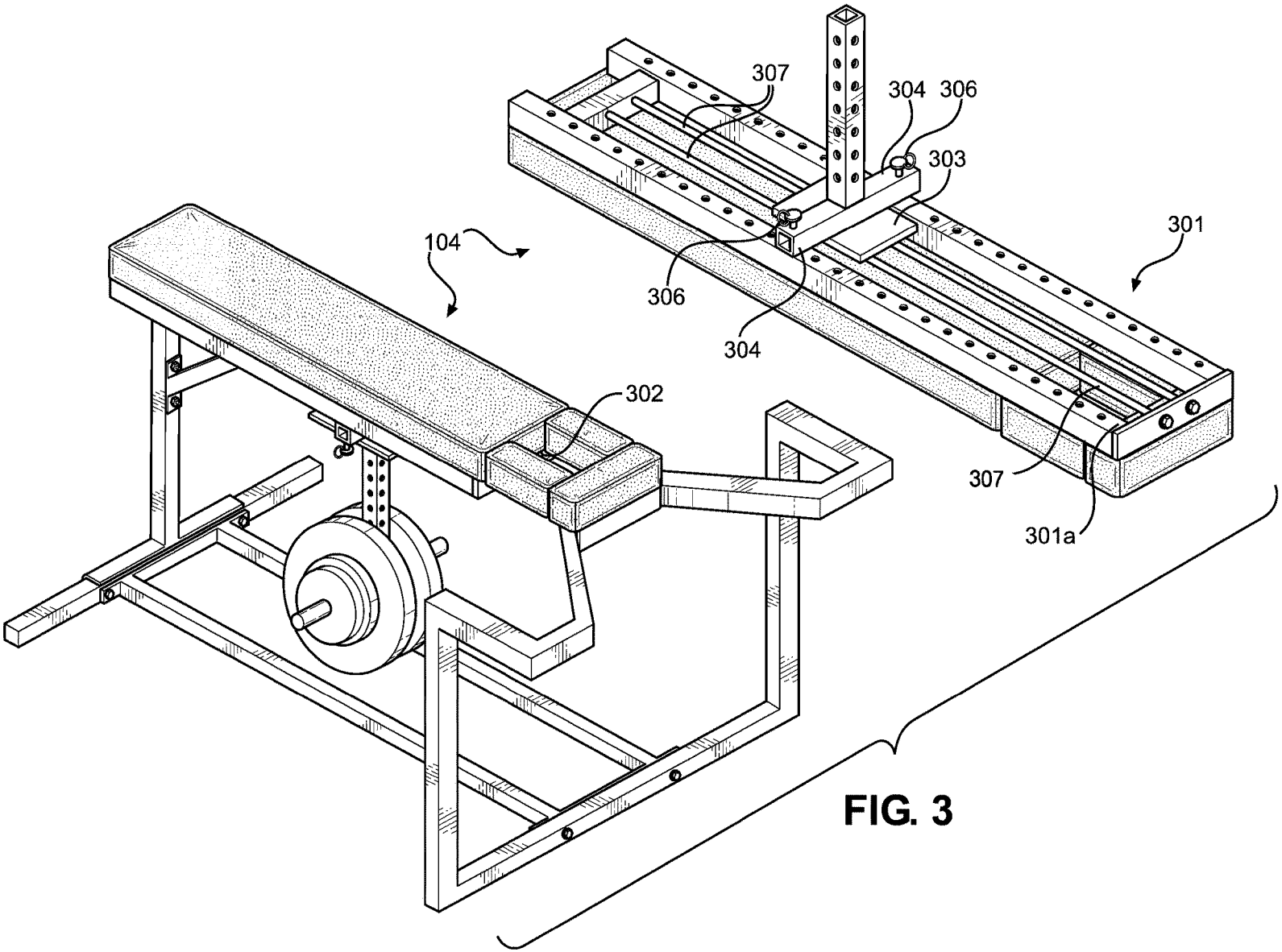
FIG. 3 shows a perspective view of an embodiment of the upper posterior development device and a callout of the pendulum device.

Referring now to FIG. 3, there is shown a perspective view of an embodiment of the upper posterior development device and a callout of the pendulum device. In one embodiment the pendulum 106 has a movable location along the underside of the bench 104. In this embodiment there is a frame 301 which runs along a majority of the perimeter of the underside of the bench 104. In some embodiments the bench 104 includes an aperture 302. The aperture 302 allows for a user to place their face therein. In this embodiment there is a frame 301*a* cutout around the aperture 302.

In this embodiment the pendulum 106 is secured to a movable plate 303. The movable plate 303 has wings 304 along apposing exterior sides. The wings 304 overlap the frame 301. In this embodiment there are apertures 305 along the frame 301. In one embodiment a single pull pin 306 is secured through one of the wings 304. In another embodiment each wing 304 each have a pull pin 306 therein. The pull pin 306 will enter one of the apertures 305. In this way the pull pin 306 will lock the movable plate 303 in place along the bench 104.

A pair of slider rods 307 are secured within the frame 301. The movable plate 303 is movably secured to the slider rods 307. The slider rods 307 coupled with the movable plate 303 will allow the pendulum 106 to be moved along the bottom of the bench 104. Once the location is selected the at least one pull pin 306 is used to secure the pendulum's 106 location along the bench 104.

Figure 4:
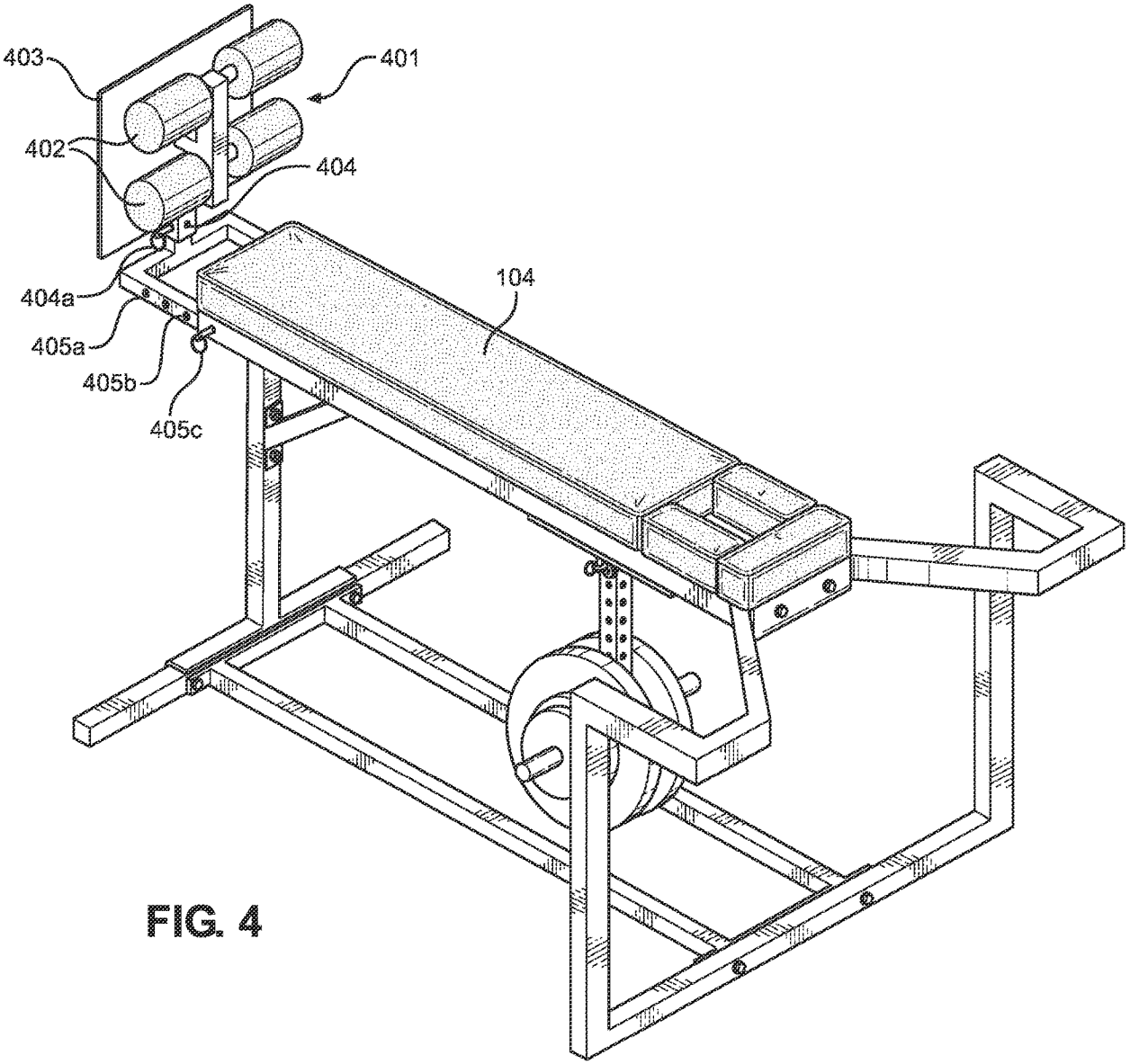
FIG. 4 shows a perspective view of an embodiment of the upper posterior development device having a foot holding attachment.

Referring now to FIG. 4, there is shown a perspective view of an embodiment of the upper posterior development device having a foot holding attachment. In one embodiment the upper posterior development device includes a foot holding attachment 401. The foot holding attachment 401 is secured to an end of the bench 104 opposite the side meant for one's head. In the shown embodiment the foot holding attachment 401 is secured to the bench 104 via a telescopic insert 405*a*. The telescopic insert 405*a* has a plurality of apertures 405*b* which run there along. A pull pin 405*c* can be locked into the apertures 405*b* through the bench 104. This will hold the foot holding attachment 104 in place while allowing for the attachment to have an adjustable distance from the bench 104.

In one embodiment the foot holding attachment 401 is comprised of a back board 403. This will ensure that the feet cannot slide too far into the foot holding attachment 401. The foot holding attachment 401 further includes a set of foot pegs 402. In one embodiment the foot pegs 402 are two pairs of pegs which extend in opposite directions. The foot pegs 402 are configured to allow a user to place their ankles there between. In one embodiment the foot pegs 402 are padded. In one embodiment the foot holding attachment 401 has an adjustable height. In this embodiment there is a telescopic adjustment point 404. The foot holding attachment 401 is then held in place via a push pin 404*a*. this ensures that the foot holding attachment 401 may be used for various sized individuals.

Figure 5:
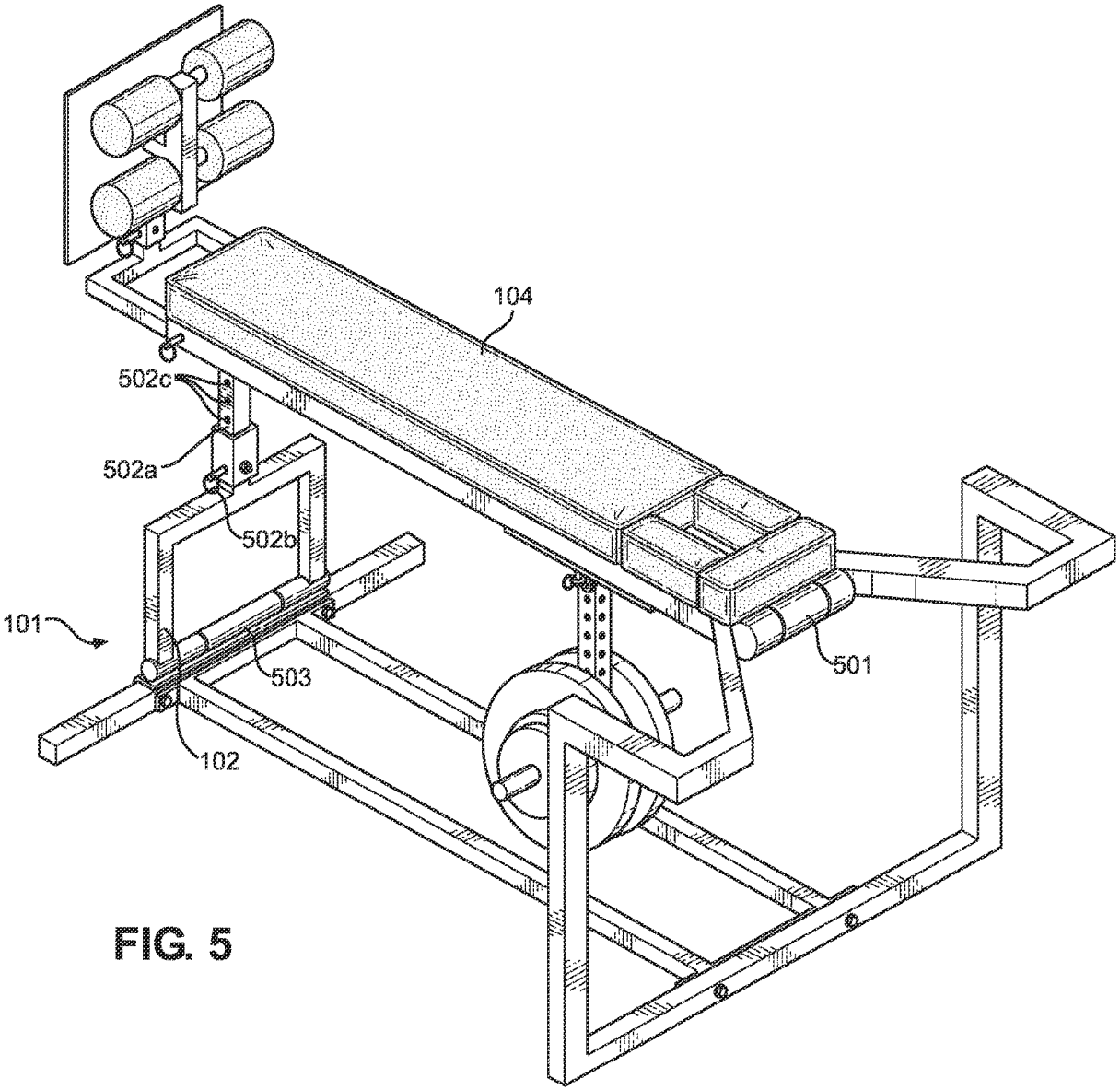
FIG. 5 shows a perspective view of an embodiment of the upper posterior development device wherein the bench is secured to the frame via a hinge.

Referring now to FIG. 5, there is shown a perspective view of an embodiment of the upper posterior development device wherein the bench is secured to the frame via a hinge. In one embodiment the bench 104 has an adjustable angle. In one embodiment the adjustable angle is facilitated by a pair of hinges 501, 503. The ability to adjust the angle of the device will allow for a user to adjust the range of motion of the device. In one embodiment the adjustment will allow for an increase in range of motion. This adjustable angle will further allow for different exercises to be performed.

In one embodiment there is a first hinge 501 at one end of the bench 104. A second hinge 503 is located within the frame 101. In the shown embodiment the second hinge 503 is located at the base of at least one leg 102. In this embodiment there is a telescopic adjustment 502*a*. The telescopic adjustment 502*a* can be used to adjust the bench 104 angle. Once the desired angle is selected a push pin 502*b* is then inserted into one of a series of equally spaced apertures 502*c*. This will lock the bench 104 at the desired angle.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An upper posterior development device, the upper posterior development device comprising:

a frame having a plurality of legs;

a bench secured to a top end of each of the plurality of legs;

a pendulum movably secured to an underside of the bench by a single arm with the single arm configured to swing along a single plane on the underside of the bench without the pendulum extending beyond an edge of the bench.

2. The upper posterior development device of claim 1, wherein the bench includes an aperture located at one end of the bench.

3. The upper posterior development device of claim 1, further comprising a cross bar which secures at least two legs of the plurality of legs together, the bench is secured to the cross bar.

4. The upper posterior development device of claim 1, wherein at least one of the plurality of legs includes a plurality of apertures located therein, a hook is removably secured to at least one of the plurality of apertures.

5. An upper posterior development device, the upper posterior development device comprising:

a frame, wherein the frame is comprised of a plurality of legs;

a bench secured to a top end of each of the plurality of legs; a track secured to an underside of the bench by a single arm with the single arm configured to swing along a single plane on the underside of the bench without the pendulum extending beyond an edge of the bench;

a pendulum movably secured to the track.

6. The upper posterior development device of claim 5, wherein the bench includes an aperture located at one end of the bench.

7. The upper posterior development device of claim 5, further comprising a cross bar to secure two legs of the plurality of legs together, the bench is then secured to the cross bar.

8. The upper posterior development device of claim 5, wherein at least one of the plurality of legs includes a plurality of apertures located therein, a hook is removably secured to at least one of the plurality of apertures.

9. The upper posterior development device of claim 5, wherein the pendulum is held in place via a plurality of apertures and at least one pull pin.

10. The upper posterior development device of claim 5, wherein the track is comprised of two rods secured at each end to the bench.

* * * * *